US007628665B1

(12) United States Patent
Cook et al.

(10) Patent No.: US 7,628,665 B1
(45) Date of Patent: Dec. 8, 2009

(54) DRILLING RISER BUOYANCY MODULES

(75) Inventors: Timothy H. Cook, Kennebunkport, ME (US); Frederick Maguire, South Berwick, ME (US); David A. Capotosto, Biddeford, ME (US)

(73) Assignee: Flotation Technologies, Inc., Biddeford, ME (US)

( * ) Notice: Subject to any disclaimer, the term of this patent is extended or adjusted under 35 U.S.C. 154(b) by 0 days.

(21) Appl. No.: 12/288,917

(22) Filed: Oct. 24, 2008

Related U.S. Application Data

(60) Provisional application No. 61/000,476, filed on Oct. 26, 2007.

(51) Int. Cl.
*B63B 22/00* (2006.01)

(52) U.S. Cl. ..... 441/133; 405/195.1

(58) Field of Classification Search ..... 441/133; 405/195.1

See application file for complete search history.

(56) References Cited

U.S. PATENT DOCUMENTS

| | | | | |
|---|---|---|---|---|
| 6,821,055 | B2 * | 11/2004 | Oram | 405/195.1 |
| 2008/0245933 | A1 | 10/2008 | Stokes | |

FOREIGN PATENT DOCUMENTS

| | | |
|---|---|---|
| AU | 5995798 | 9/1998 |
| AU | 2006318970 | 5/2007 |
| EP | 1850044 | 10/2007 |
| GB | 2288205 | 10/1995 |
| GB | 2322406 | 8/1998 |
| GB | 2391255 | 2/2004 |

* cited by examiner

*Primary Examiner*—Stephen Avila
(74) *Attorney, Agent, or Firm*—James Creighton Wray; Meera P. Narasimhan

(57) ABSTRACT

Buoyancy modules for subsea riser pipes are made of syntactic foam solid cores covered with tough high density polyethylene shells. Inner surfaces have partial semi-cylindrical surfaces to fit the riser pipes. Internal radial grooves hold flexible contact pads. Recesses in the inner surfaces hold auxiliary lines. Flat surfaces between the inner and outer semi-cylindrical surfaces have complementary longitudinally extending semi-cylindrical grooves to position choke and kill lines. Grooves in the outer semi-cylindrical surfaces hold composite fiber tensioning straps directly outward from the flexible contact pads. Flat areas of the grooves hold tensioning hardware. Tensioning the straps grips the riser pipe with the pads and grips the choke and kill lines in the semi-circular grooves. Cavities in the ends allow the buoyancy module halves to be assembled on the riser pipe around clamps which hold the accompanying lines.

16 Claims, 6 Drawing Sheets

100
112
114
60
100

122
118
120
116
60

79
120
116
122
118

90
148
146

140
132
128
136
130
138
134
124
150
126
144

126
145
142
130
134
142

DRILLING RISER BUOYANCY MODULES

This application claims the benefit of U.S. Provisional Application No. 61,000,476, filed Oct. 26, 2007, which is hereby incorporated by reference in its entirety.

SUMMARY OF THE INVENTION

Drilling riser buoyancy for subsea oil production has traditionally been produced using fiberglass skins. This invention used a polymer shell coating over a solid syntactic foam that is formed into the shape required and filled with the buoyant material. This method produces a product that is superior in both its performance, as well as, manufacturability.

Buoyancy modules for subsea riser pipes are made of syntactic foam solid cores covered with tough high density polyethylene shells. Inner surfaces have partial semi-cylindrical surfaces to fit the riser pipes. Internal radial grooves hold flexible contact pads. Recesses in the inner surfaces hold auxiliary lines. Flat surfaces between the inner and outer semi-cylindrical surfaces have complementary longitudinally extending semi-cylindrical grooves to position choke and kill lines. Grooves in the outer semi-cylindrical surfaces hold composite fiber tensioning straps directly outward from the flexible contact pads. Flat areas of the grooves hold tensioning hardware. Tensioning the straps grips the riser pipe with the pads and grips the choke and kill lines in the semicircular grooves. Cavities in the ends allow large radius bending of the riser pipe and accompanying lines.

Previous products are subject to damage as the pipe and buoyancy are handled and as they travel through the diverter housing during installation. They are also subject to damage during installation on the drilling riser and during handling of the dressed pipe.

About 200 to 300 million dollars of drill riser buoyancy are purchased every year. That amount is rising as the cost of oil rises. The method of this invention is a direct replacement for existing product.

The invention reduces total cost of ownership for offshore drilling firms, because module breakage during operations results in downtime and constitutes a hazard to drilling personnel. Repairing broken modules is expensive and forces drilling companies to purchase more buoyancy modules than required to account for breakage. Time is lost during the repair process.

Two opposite halves of drilling riser buoyancy module apparatus have complementary central openings for the riser pipe and axially extending recesses for receiving and holding auxiliary lines. Each half has a generally semi-cylindrical syntactic foam solid core with self skin. The syntactic foam core has an axially extended semi-cylindrical outer surface, an axially extended curved partially semi-cylindrical inner surface. Radially opposite and radially and axially extending generally flat faces extend between the outer and inner surfaces. The axially and radially extending faces have complementary semi-circular depressions for receiving and holding a choke line and a kill line in the depressions. The inner surfaces are configured to flexible drilling riser pipe circumferential requirements. Longitudinally extended outward recesses in the curved inner surface receive auxiliary lines. Spaced semi-cylindrical recesses in the curved inner semi-cylindrical surfaces hold flexible contact pads. The flexible contact pads positioned in the spaced inner semi-cylindrical recesses extend inward therefrom for contacting the drilling riser pipe. Outer semi-cylindrical grooves located opposite and outward from the inner semi-cylindrical recesses hold tensioning straps, which cooperate with the contact pads to compress the contact pads on the drilling riser.

A tough high density polyethylene outer shell coats fastened to the outer surface and the outer grooves of the syntactic foam solid core. Composite fiber tensioning straps are positioned in the outer grooves. Tensioning hardware at ends of the composite fiber tensioning straps for tightly tension the straps.

The outer grooves are sufficiently deep to position the straps below the outer surface. The outer grooves have flattened sections at a position between the faces for positioning the tensioning hardware in the flattened sections below the outer surface.

Loops at ends of the straps engage the tensioning hardware. Parallel bars extending through the loops in axial directions of the module, and lockable threaded fasteners interconnect the bars.

End recesses in the ends of the inner surfaces of the core halves allow the buoyancy module halves to be assembled around clamps which hold auxiliary lines at longitudinal ends of the buoyancy modules.

Intersections of the outer surfaces of the buoyancy module and the axial ends of the halves are beveled. The bevels, axial ends and recess are coated with the tough high density polyethylene outer shell.

These and further and other objects and features of the invention are apparent in the disclosure, which includes the above and ongoing written specification, with the drawings.

DETAILED DESCRIPTION OF THE PREFERRED EMBODIMENTS

Figure 3:
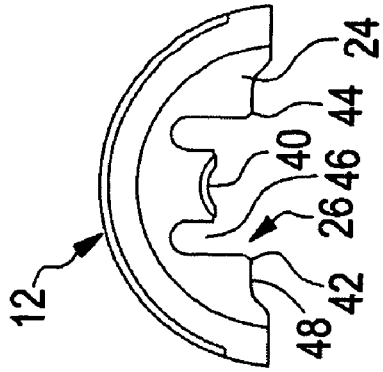
FIG. 3 is a right end elevation of the buoyant riser cover half shown in FIG. 1.
Figure 1:
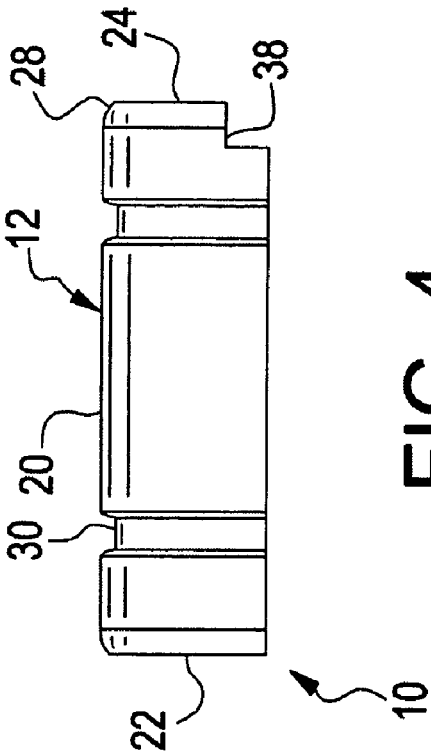
FIG. 1 is a side elevation of a buoyant riser cover half.
Figure 4:
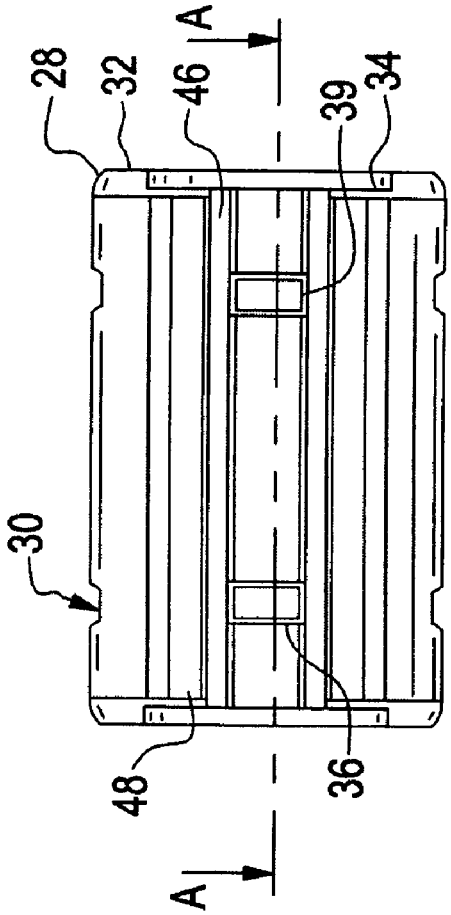
FIG. 4 is a bottom view of the buoyant riser cover half shown in FIG. 1.
Figure 2:
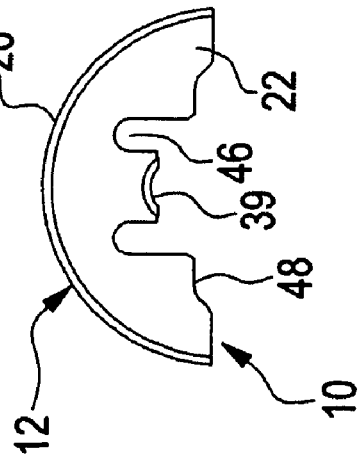
FIG. 2 is a left end elevation of the buoyant riser cover half shown in FIG. 1.
Figure 5:
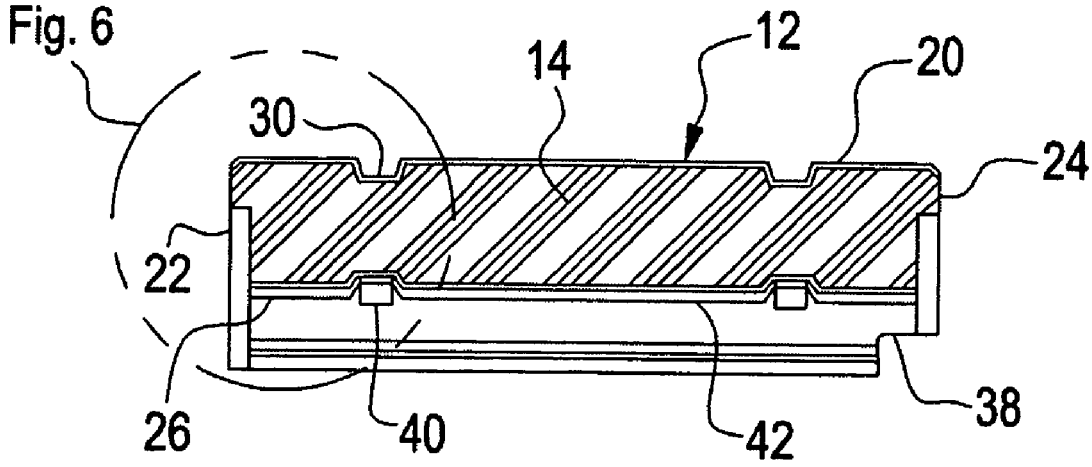
FIG. 5 is a cross-sectional side elevation of the buoyant riser cover half taken along line A-A of FIG. 4.
Figure 6:
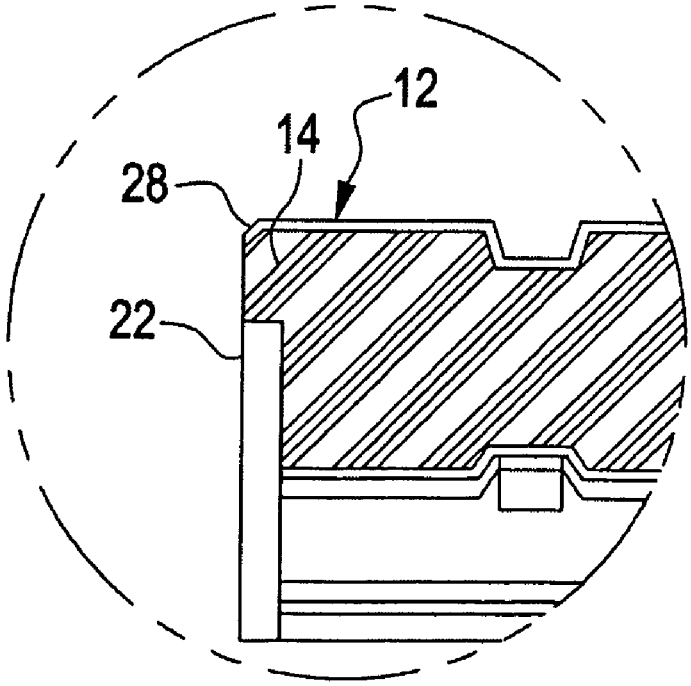
FIG. 6 is an end detail of the side elevation of the buoyant riser cover half taken along the circle in FIG. 5.

FIGS. 1-6 show a drilling riser buoyancy half 10 of the new invention. A tough plastic outer shell 12 is filled with buoyant material 14 which may be closed cell foam or a syntactic foam solid core.

The plastic shell 12 extends around the outside 20, ends 22, 24 and inside 26 of the half.

Grooves 30 are formed in the outside of the covers 10 to receive securing bands. Ends 22, 24 are tapered 28 to provide strengthened abutting surfaces 32 of the covers. Cavities 34 are formed in ends 22, 24 to receive auxiliary line clamps previously positioned on a drilling riser. Grooves 36 provide access for flexible resilient pads 39. Ends 22 or 24 have steps 38 which, when juxtaposed, provide access for clamps.

Insides 26 of the cover halves 10 have short riser pipe configured surfaces 40, 42, 44 for positioning around the drilling riser pipe and provide recesses 46, 48 for holding auxiliary lines along the drilling risers, and permitting relative differential movements of expansion.

The polymer shell 12 is formed into the shape required and then filled with the buoyant material 14. This resultant buoyant cover 10 is superior in both its performance, as well as, manufacturability.

The new buoyant covers 10 are not subject to damage as the pipe and buoyancy are handled and as they travel through the diverter housing during installation. They resist damage during installation on the drilling riser and during handling of the dressed pipe joint.

The method of this invention is a direct replacement for existing product.

The buoyant covers 10 reduce total cost of ownership for offshore drilling firms. The buoyant covers 10 reduce or eliminate module breakage during operations resulting in reduced downtime and reduction of hazards to drilling personnel. The new buoyant covers eliminate expenses of repairing broken modules, and eliminate purchasing of more buoyancy modules than required to account for breakage.

Referring to FIGS. 7-10 a buoyancy module is generally indicated by the numeral 50. Module 50 has a syntactic foam solid core 52 and is formed of two halves 54 and 56, which are held together by a composite fiber tensioning strap 58. Each solid core 52 is half covered by a high density polyethylene outer shell 60, which also covers ends 62 and 64.

Beveled edges 66 between the outer surface 68 of the shell 60 and the ends of 62 and 64 of module 50 protect the integrity of the entire module shell at its critical surface intersections.

Ends 62 and 64 have cavities 70, which allow the module halves to be assembled around one or two auxiliary line clamps previously placed on the riser pipe at the one or the other or both ends of the module.

Halves 54 and 56 have generally semi-cylindrical outer surfaces 14, with parallel grooves 76 for holding the tensioning straps 58. Flattened areas 78 of the grooves hold the tensioning hardware 79. The depths of the grooves and flattened areas are sufficient to hold the straps 58 and tensioning hardware below the outer surfaces 74. The flattened areas provide direct access to tightening fasteners. The outer surfaces 74 and grooves 76 are coated with the high density polyethylene out shell 60.

Inner surfaces 80 of the halves 54 and 56 have generally semi-cylindrical areas 82 and 84 which are sized slightly larger than the riser pipe diameter. Circumferential grooves 86 in the cylindrical areas 82 hold flexible contact pads 90 that are compressed against the riser pipe and hold the buoyancy modules 50 in position on the riser pipe.

The flexible contact pads are located directly inward from the outer grooves 76 and straps 58, so that tensioning the straps compresses the contact pads 90, while tightening a gap 88 between the halves 54 and 56.

The inner surfaces 80 also have axially extending recesses 92, 94, 96 to hold auxiliary lines, which are clamped to the riser pipe.

Generally flat surfaces 100 extend radially between the outer surfaces 74 and inner surfaces 80 of the halves 54 and 56. Outer parts of the flat surfaces extend from end 62 to end 64, and inner parts of the flat surfaces extend between the bell cavities 70 in the ends.

Opposite semi-cylindrical recesses 102 in the flat surfaces are configured to hold a kill line and a choke line, which are clamped to the riser pipe.

The bell cavities 70 at opposite ends 62 and 64 of the buoyancy modules allow the module halves to be joined around auxiliary line clamps previously clamped to the riser with a clamp or clamps at one or both ends of the buoyancy modules.

Openings 104 in the ends 62 and 64 in FIGS. 8, 11, 13 and 17 are fill ports used in the production of the module halves. The shell is made first in a rotomolding process and is a rigid structure. The syntactic foam mixture of an epoxy resin system and hollow glass microspheres is pumped into the shell, where the mixture cures into the rigid buoyancy material. After pumping in the foam, the hole is capped off.

FIGS. 11-14 show one of the syntactic foam solid cores 52 for the halves 54, 56. In these drawings, the core 52 is for the upper half 54 shown in FIGS. 7-10. The lower core 56 has a different inner surface configuration for holding auxiliary lines.

Figure 16:
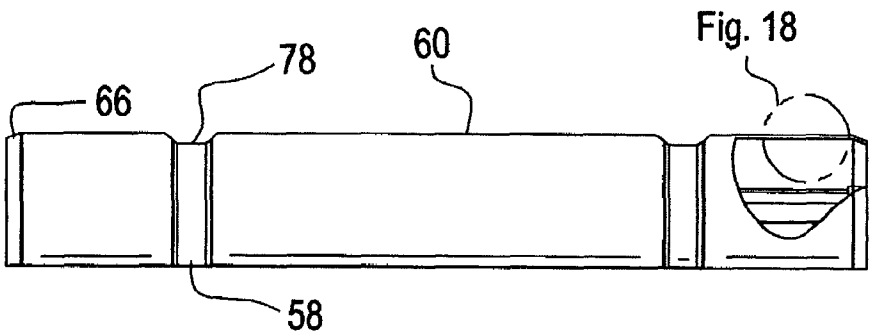
FIG. 16 is an elevation view of the coated syntactic foam core half shown in FIG. 15.
Figure 18:
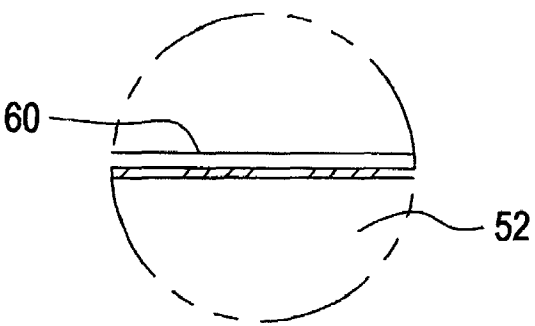
FIG. 18 is a cross sectional elevational detail of the syntactic foam core taken from the circle in FIG. 16.
Figure 15:
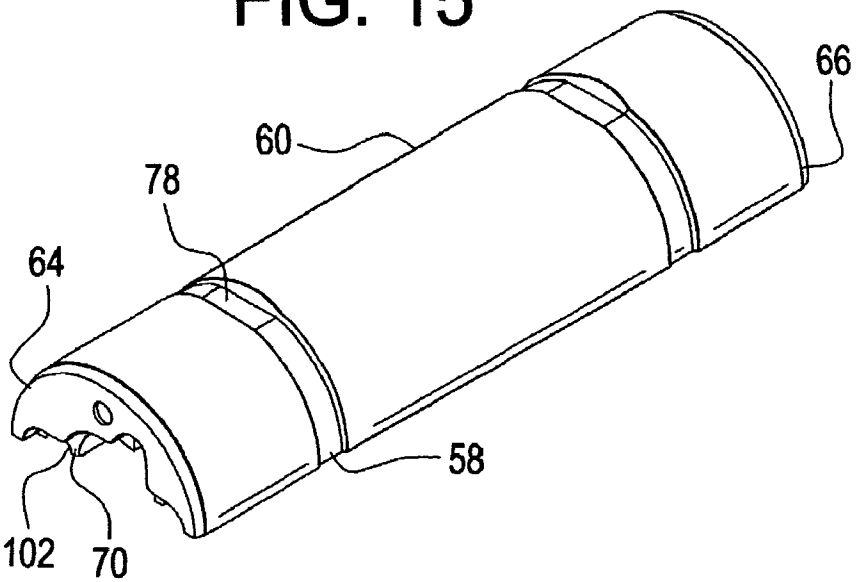
FIG. 15 is a perspective view of a syntactic foam core half covered with a tough high density polyethylene shell.
Figure 17:
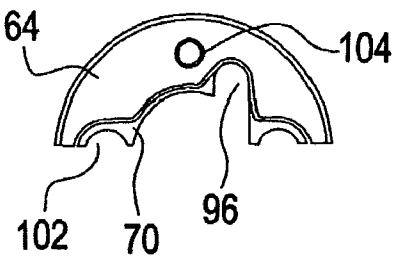
FIG. 17 is a left end view of the coated syntactic foam core half shown in FIGS. 15 and 16.

FIGS. 15-17 shows the opposite end 64 of the upper half 54 coated with the high density polyethylene outer shell 60. FIG. 18 shows the high density polyethylene outer shell 60 coating the syntactic foam solid core 52.

Figure 10:
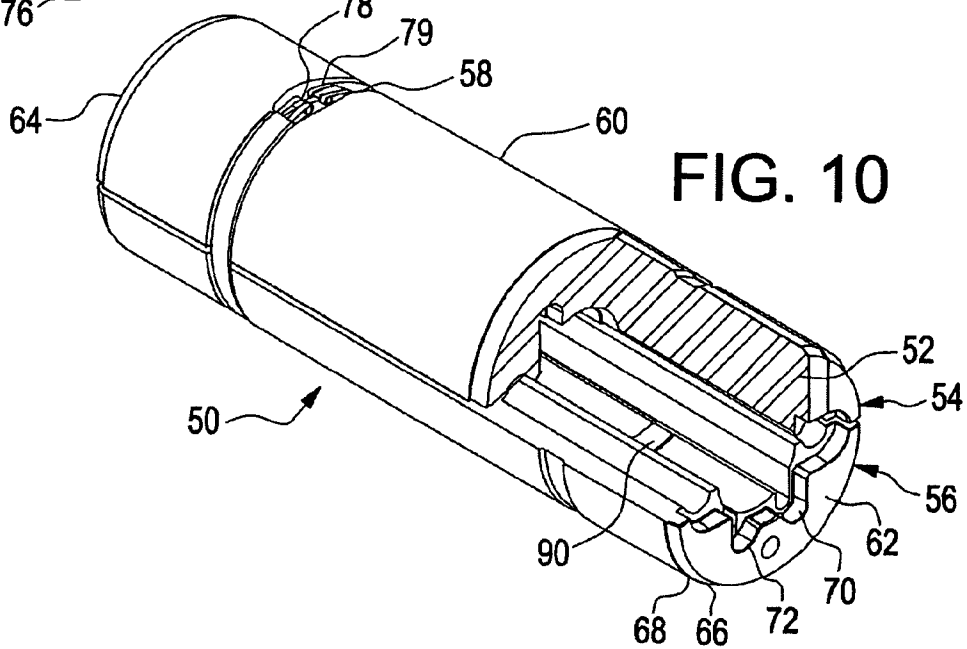
FIG. 10 is a perspective view of the buoyancy module shown in FIGS. 7-9 partially cut away to show the syntactic foam core and the flexible contact pad.
Figure 9:
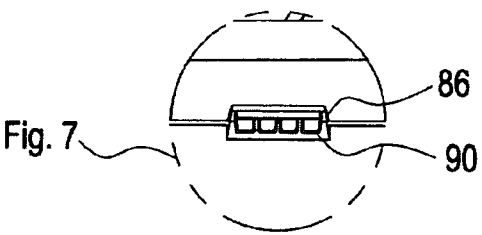
FIG. 9 is a detail of the flexible contact pad taken from the circle in FIG. 7.
Figure 12:
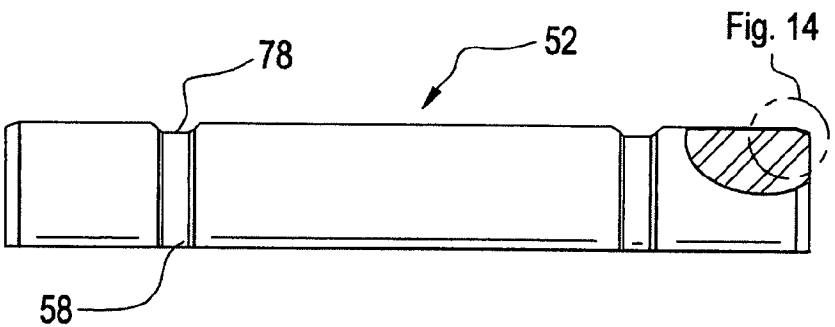
FIG. 12 is an elevation view of the syntactic foam core solid half shown in FIG. 11.
Figure 14:
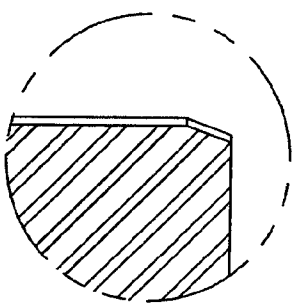
FIG. 14 is a cross sectional elevational detail of the syntactic foam core taken from the circle in FIG. 12.
Figure 11:
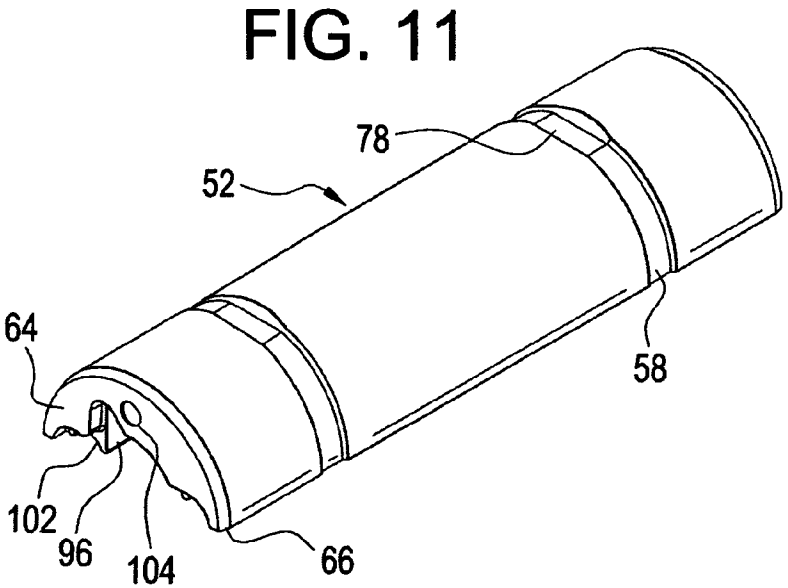
FIG. 11 is a perspective view of a syntactic foam solid core half.
Figure 13:
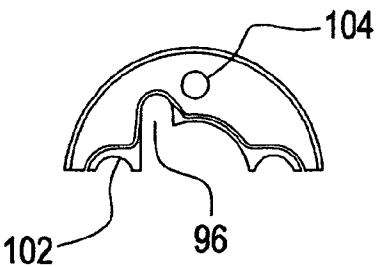
FIG. 13 is a left end view of the syntactic foam core half shown in FIGS. 11 and 12.
Figures 19, 20, 21, 22, 23, 24:
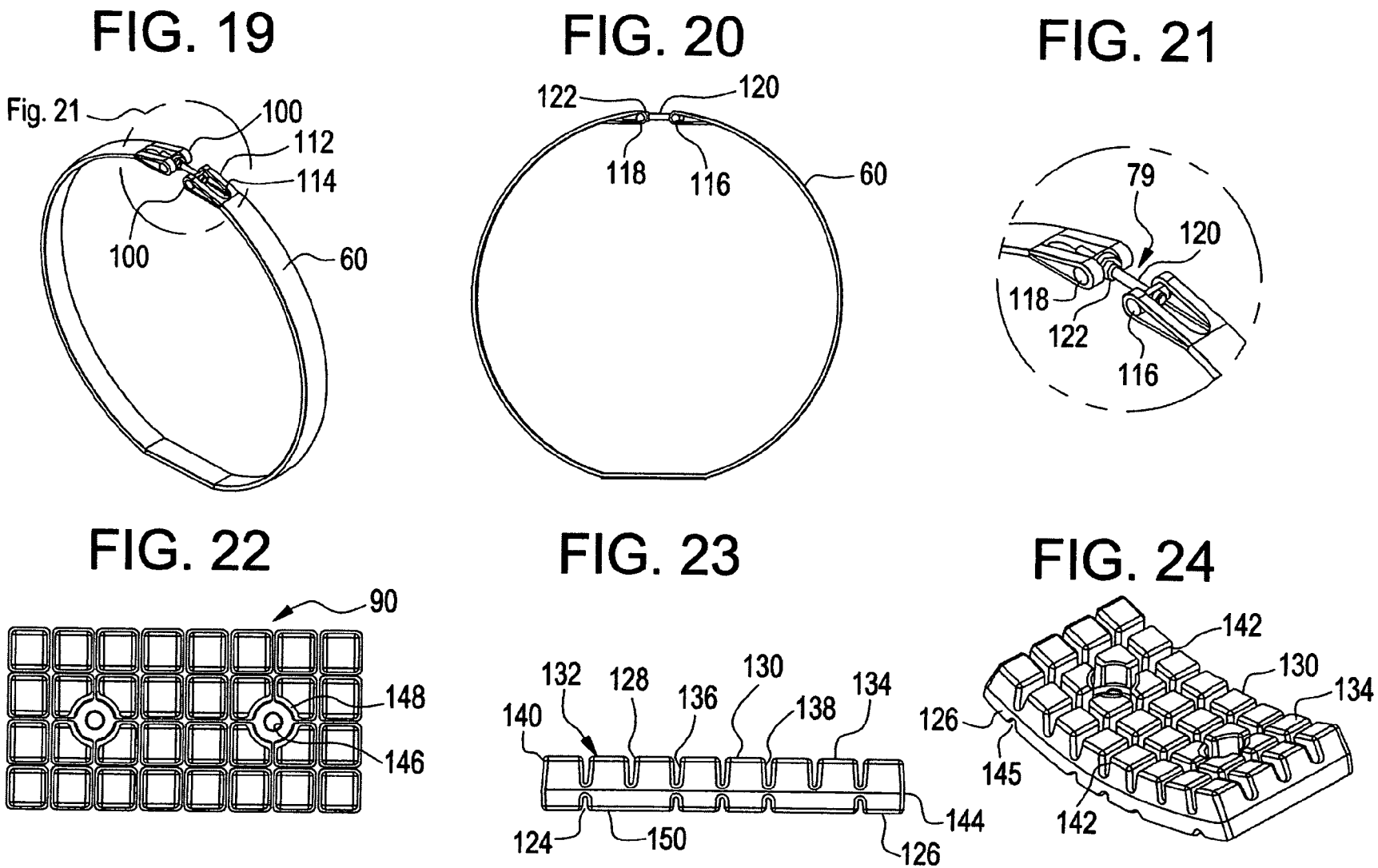
FIG. 19 is a perspective view of the composite fiber tensioning strap assembly shown in FIGS. 7 and 10.
FIG. 20 is an end view of the composite fiber tensioning strap assembly shown in FIG. 19.
FIG. 21 is a detail of the tensioning hardware in the composite fiber tensioning strap assembly shown in FIGS. 19 and 20.
FIG. 22 is a plan view of the flexible contact pad shown in FIGS. 9 and 10.
FIG. 23 is a side elevation of the flexible contact pad shown in FIG. 21.
FIG. 24 is a perspective view of the flexible contact pad of FIGS. 22 and 23 shown in a flexed state.

FIGS. 19-21 are views of a composite tensioning strap 60 and the tensioning hardware 79 as shown in FIG. 10. Strap 60 is a fiber reinforced composite strap such as Kevlar, which is made with ends 100, each having two loops 112 which are separated by openings 114. Rods 116 and 118 are inserted in the loops. Bolt 120 passes through a hole in rod 116 and engages a threaded hole in rod 118. After the bolt is tightened, a lock nut 122 secures the bolt against turning in either direction.

Figure 8:
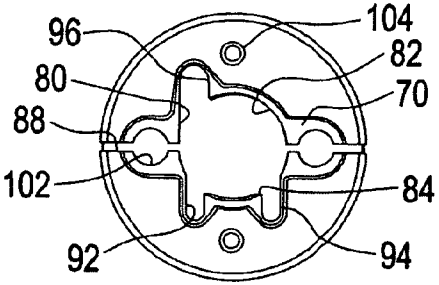
FIG. 8 is an end view of the buoyancy module shown in FIG. 7.
Figure 7:
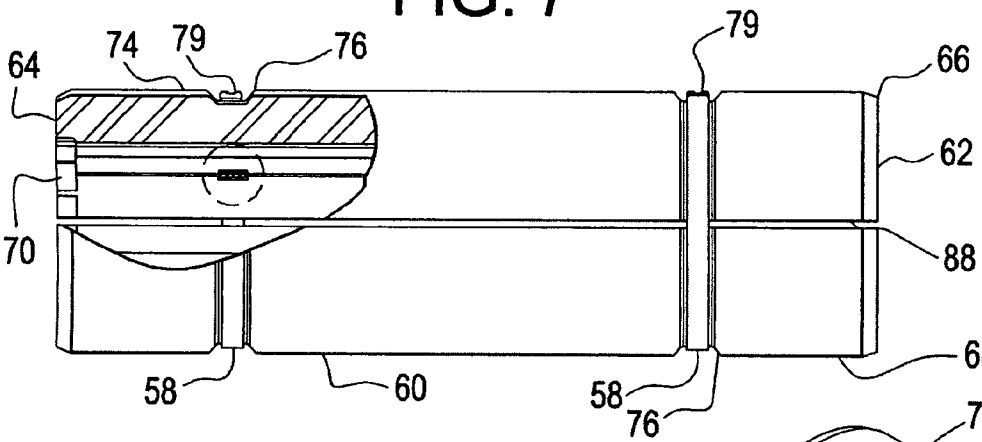
FIG. 7 is an elevation of the buoyancy module partially cut away to show the syntactic foam core and the flexible contact pad.

FIGS. 22-24 illustrate the flexible contact pads 90 shown in FIGS. 7-10. Flexible contact pads 90 are pressed into the internal grooves 86 in the halves 54 and 56 before the halves are assembled on the riser pipe. The flexible contact pads are positioned opposite each other as shown in FIG. 8 when the halves are assembled on the riser pipe.

The pads are integrally formed and have relatively shallow, rectangularly arranged grooves 124 in and outer side 126 and deeper grooves 128 in the inner side 130, forming waffle-like protrusions 132 on the inner side. Protrusions 132 have flat tops 134 and sloping sides 136 with radiused edges 138 between the adjacent sides 136 and radiused edges 140 between the tops 134 and sides 136.

The grooves 128 in the inner side are generally "V" shaped, wider at their tops and narrower at their bases, so that the transverse outer grooves 142, which run across the shorter dimension, tend to narrow as the flexible contact pad is flexed into operative position, as shown in FIG. 24.

A central area 144 of the flexible contact pad flexes and the outer side 126 tends to elongate slightly, expanding transverse outer grooves 145 and compressing transverse inner grooves 142 as the inner side 130 tends to shorten.

Bolt holes 146 are surrounded by curved radiused sides 148 of the inner protrusions 132. Grooves 124 in the lower side are omitted in the region of the bolt holes, forming reinforced sections 150. Bolts are inserted through bolt holes to secure the flexible contact pads 90 in internal grooves 86 in the cover halves. Alternatively grooves 86 in the cover halves may be formed with projections to engage the holes 146 and hold the pads flexed in the grooves.

The flexible contact pads 90 are made of a flexible elastomer material, such as rubber, and are bendable in one direction, but are relatively rigid against compression of the waffle-like protrusions 132, which present solid material from the inner side 130 to the outer side 126. The tops 134 of the protrusions have friction surfaces which tightly engage the outer surface of the riser pipe, holding the buoyancy module in fixed position on the riser pipe.

In use the halves 54 and 56 are assembled on a riser by placing auxiliary lines in grooves 92 and 94 in lower half 56 as the lower half is placed on a riser pipe. A choke line and a kill line are placed in semi-cylindrical grooves 102 in the lower half 56. The upper half 54 is placed over an upper auxiliary line, which fits in groove 96, and over the riser pipe, while locating choke and kill lines in the complementary semi-circular grooves 102 of the upper half.

Composite fiber tensioning straps 60 are placed in grooves 58 in outer surfaces of the halves, and power wrenches are used to tighten bolts 120 in the tensioning hardware 79. A lock nut 212 is torqued against one rod.

The flattened surfaces 78 of the grooves 58 provide straight in access to torque the bolts 120. Flattened areas 78 of grooves 58 are provided in both grooves on each half to facilitate positioning and tightening of the hardware 79 above or below the halves.

When the buoyancy module is fully installed, the flexible contact pads hold the buoyancy module against shifting along the riser pipe. The opposing grooves 102 tightly hold the choke and kill lines. The cavities 70 in the ends 62 and 64 allow large radius bending of the riser pipe, choke and kill lines and auxiliary lines at the ends of the buoyancy module.

While the invention has been described with reference to specific embodiments, modifications and variations of the invention may be constructed without departing from the scope of the invention.

We claim:

1. Drilling riser buoyancy module apparatus comprising:

two opposite halves having complementary axially extending openings for receiving and holding auxiliary lines, each half having a generally semi-cylindrical syntactic foam solid core, the syntactic foam core having an axially extended semi-cylindrical outer surface, an axially extended curved partially semi-cylindrical inner surface and radially opposite and radially and axially extending generally flat faces between the outer and inner surfaces, the axially and radially extending faces having semi-circular depressions for receiving and holding a choke line and a kill line in the depressions, the inner surfaces being configured to flexible drilling riser pipe circumferential requirements, longitudinally extended outward recesses in the curved inner surface to receive auxiliary lines, spaced semi-cylindrical recesses in the curved inner semi-cylindrical surfaces for holding flexible contact pads, flexible contact pads positioned in the spaced inner semi-cylindrical recesses and extending inward therefrom for contacting the drilling riser, outer semi-cylindrical grooves located outward from the inner semi-cylindrical recesses for holding tensioning straps cooperating with the contact pads to compress the contact pads on the drilling riser, a tough high density polyethylene outer shell coating fastened to the outer surface and the outer grooves of the syntactic foam solid core, composite fiber tensioning straps positioned in the outer grooves, tensioning hardware at ends of the composite fiber tensioning straps for tightly tensioning the straps.

2. The buoyancy module apparatus of claim 1, wherein the grooves are sufficiently deep to position the straps below the outer surface.

3. The buoyancy module apparatus of claim 2, wherein the grooves have flattened sections at positions between the faces for positioning the tensioning hardware in the flattened sections below the outer surface.

4. The buoyancy module apparatus of claim 1, further comprising loops at ends of the straps, wherein the tensioning hardware comprises parallel bars extending through the loops in axial directions of the module and lockable threaded fasteners interconnecting the bars.

5. The buoyancy module apparatus of claim 1, further comprising:

end cavities in the ends of the core halves for allowing the buoyancy module halves to be assembled on the drilling riser around a clamp or clamps that hold auxiliary lines at longitudinal ends of the buoyancy modules.

6. The buoyancy module apparatus of claim 5, wherein intersections of the outer surfaces and the axial ends of the halves are beveled.

7. The buoyancy module apparatus of claim 6, wherein the bevels, axial ends and recess are coated with the tough high density polyethylene outer shell.

8. Drilling riser buoyancy module apparatus comprising:

semi-cylindrical syntactic foam solid core halves, tough high density polyethylene shells on the solid core halves, the halves having semi-cylindrical outer surfaces and curved partial semi-cylindrical inner surfaces spaced inward from the outer surfaces for holding the riser pipe and opposite flat surfaces extending between the outer and inner surfaces, spaced semi-cylindrical recesses in the curved inner semi-cylindrical surfaces for holding flexible contact pads, complementary longitudinally extending semi-cylindrical grooves in the flat surfaces for receiving and holding choke and kill lines spaced from and on opposite sides of a riser pipe within the inner surfaces, the outer surfaces having spaced parallel circumferential grooves, composite fiber tensioning strap assemblies in the circumferential grooves for urging the halves together and tightening the complementary longitudinally extending semi-cylindrical grooves in the flat surfaces on the choke and kill lines.

9. The drilling riser buoyancy module apparatus of claim 8, further comprising: longitudinally extended outward recesses in the curved inner surface to receive auxiliary lines.

10. The drilling riser buoyancy module apparatus of claim 8, further comprising:

tensioning hardware at ends of the composite fiber tensioning straps for tightly tensioning the straps.

11. The buoyancy module apparatus of claim 8, wherein the grooves are sufficiently deep to position the straps below the outer surface.

12. The buoyancy module apparatus of claim 11, wherein the grooves have flattened sections at a position between the faces for positioning the tensioning hardware in the flattened sections below the outer surface.

13. The buoyancy module apparatus of claim 8, further comprising loops at ends of the straps, wherein the tensioning hardware comprises parallel bars extending through the loops in axial directions of the module and lockable threaded fasteners interconnecting the bars.

14. The buoyancy module apparatus of claim 8, further comprising: end cavities in the ends of the core halves for allowing the halves to be assembled on the drilling riser with a previously assembled clamp for auxiliary lines at one or both longitudinal ends of the buoyancy module.

15. Drilling riser buoyancy module apparatus comprising:

semi-cylindrical syntactic foam solid core halves, tough high density polyethylene shells on the solid core halves, the halves having semi-cylindrical outer surfaces and curved partial semi-cylindrical inner surfaces spaced inward from the outer surfaces for holding the riser pipe and opposite flat surfaces extending between the outer and inner surfaces, complementary longitudinally extending semi-cylindrical grooves in the flat surfaces for receiving and holding choke and kill lines spaced from and on opposite sides of a riser pipe within the inner surfaces, the outer surfaces having spaced parallel circumferential grooves, composite fiber tensioning strap assemblies in the circumferential grooves for urging the halves together and tightening the complementary longitudinally extending semi-cylindrical grooves in the flat surfaces on the choke and kill lines, end cavities in the ends of the core halves for allowing the halves to be assembled on the drilling riser with a previously assembled clamp for auxiliary lines at one or both longitudinal ends of the buoyancy module, wherein intersections of the outer surfaces and the axial ends of the halves are beveled.

16. The buoyancy module apparatus of claim 15, wherein the bevels, axial ends and cavities are coated with the tough high density polyethylene outer shell.

* * * * *